United States Patent [19]

Schiel

[11] Patent Number: 4,663,864

[45] Date of Patent: May 12, 1987

[54] STEAM HEATED DRYING CYLINDER FOR PAPER MAKING

[75] Inventor: Christian Schiel, Heidenheim, Fed. Rep. of Germany

[73] Assignee: J. M. Voith, GmbH, Heidenheim, Fed. Rep. of Germany

[21] Appl. No.: 847,466

[22] Filed: Apr. 3, 1986

[30] Foreign Application Priority Data

Apr. 13, 1985 [DE] Fed. Rep. of Germany ..... 3513286

[51] Int. Cl.[4] ..... F26B 13/08

[52] U.S. Cl. ..... 34/125; 34/119; 34/124

[58] Field of Search ..... 34/124, 125, 119; 165/90

[56] References Cited

U.S. PATENT DOCUMENTS 3,914,875 10/1975 Schiel ..... 34/41

FOREIGN PATENT DOCUMENTS 2338922 2/1975 Fed. Rep. of Germany .

2449651 4/1976 Fed. Rep. of Germany ..... 34/125

2757579 5/1979 Fed. Rep. of Germany ..... 34/124

1473419 5/1977 United Kingdom .

*Primary Examiner*—Larry I. Schwartz

*Attorney, Agent, or Firm*—Lon H. Romanski

[57] ABSTRACT

A drying cylinder, which can be steam heated, has the following features: The cylinder shell has on its internal surface circumferential grooves in which condensate from the steam collects; to remove the condensate from the drying cylinder there is provided at least one condensate collection pipe, extending at right angles over the circumferential grooves, to which several suction pipes extending into the grooves are connected; in the direction of the flow of the condensate, in front of the inlet region of each individual suction pipe, there is provided a condensate conveying element which has a guide surface parallel to the bottom of the circumferential groove; the guide surface always lies between the bottom of the circumferential groove and the inlet end of the suction pipe.

10 Claims, 9 Drawing Figures

STEAM HEATED DRYING CYLINDER FOR PAPER MAKING

FIELD OF THE INVENTION

This invention relates generally to rotatable drying cylinder assemblies and more particularly to such drying cylinder assemblies which comprise circumferential grooves on the internal surface of the cylinder shell and which employ steam flowing to the interior thereof for the heating thereof and, further, to apparatus associated with such drying cylinder assemblies for the removal of condensate, resulting from the cooling of said steam, from the interior of said drying cylinder assembly.

BACKGROUND OF THE INVENTION

In various industries or arts, it is necessary, as part of the overall process, to dry a continuous sheet or strip of material. For example, in the art of paper-making, the relatively wet or damp strip or web of paper fibers is often passed over and mostly about a rotatable drum or cylinder assembly which is heated in order to thereby evaporate the moisture of the wet or damp paper sheet in contact with and passing about the outer cylindrical surface of such rotatable drum or cylinder asssembly.

The prior art has employed steam for the heating of such rotatable drying drums or cylinder assemblies. More specifically, heretofore, the prior art has employed a drying cylinder or drum assembly comprised of a cylindrical shell having axially closed end-walls defining an inner chamber into which, as through the axis of rotation in an end wall, steam is supplied in order to sufficiently heat the cylindrical shell, and the outer cylindrical surface thereof, and thereby achieve the desired degree of drying of the paper sheet or material passing in contact with the said outer cylindrical surface.

The steam thusly admitted into the inner chamber of the drying cylinder or drum assembly, upon giving-up some of its heat, forms a condensate within said inner chamber and, obviously, such condensate must be removed in order to maintain a continuous drying process.

One type of drying cylinder, thusly heated by steam, comprises a plurality of circumferential grooves on the internal surface of the cylinder shell in which condensate collects and at least one condensate collection pipe or conduit for removing condensate from the drying cylinder wherein such collection pipe extends transversely across said circumferential grooves and to which suction pipes or conduits extending into said grooves are connected. Such type of drying cylinder has heretofore become known from Federal Republic of Germany Patent Specification No. 23-38-922 which is equivalent to United Kingdom Letters Patent No. 1,473,419 and U.S. Pat. No. 3,914,875.

In such type of prior art drying cylinder it is particularly important that heat transmission through the cylinder wall is equal in all zones of the outer cylindrical surface or shell face. This presupposes that in particular, the thickness of the film of condensate formed in said circumferential grooves is uniform over the entire circumference. However, as a result of the suction effect this is not the case directly in the vicinity of the condensate suction pipes which project into the circumferential grooves. There the film of condensate or the flow of condensate, respectively, is thinner. Heat transmission is therefore significantly higher at these points.

According to said Patent Specification No. 23-38-922, inserts are provided in the grooves and the purpose of these is to produce turbulence in the film of condensate. The problem is somewhat alleviated by this but not completely solved.

The invention as herein disclosed is primarily directed to the solution of the problem of uneven heating of the cylinder shell face of such prior art drying cylinder.

SUMMARY OF THE INVENTION

According to the invention a drying cylinder assembly of the type heated by steam and having a plurality of circumferential grooves on the internal surface of the cylinder shell and at least one condensate collection pipe for removing condensate from the drying cylinder wherein said pipe extends transversely across said circumferential grooves and to which suction pipes extending into the grooves are connected, comprises a condensate conveying element situated in the inlet region of each of said suction pipes, each of said condensate conveying elements comprises a guide surface extending substantially parallel to the bottom of the groove, and each of said guide surfaces being positioned between the bottom of the groove and the inlet end of the suction pipe.

A main object of the invention is to construct a drying cylinder assembly, of the type hereinbefore referred to, so that extensively uniform heating of the external face of the cylinder shell over its circumference is achieved even, in particular, in the region of the condensate suction pipes.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
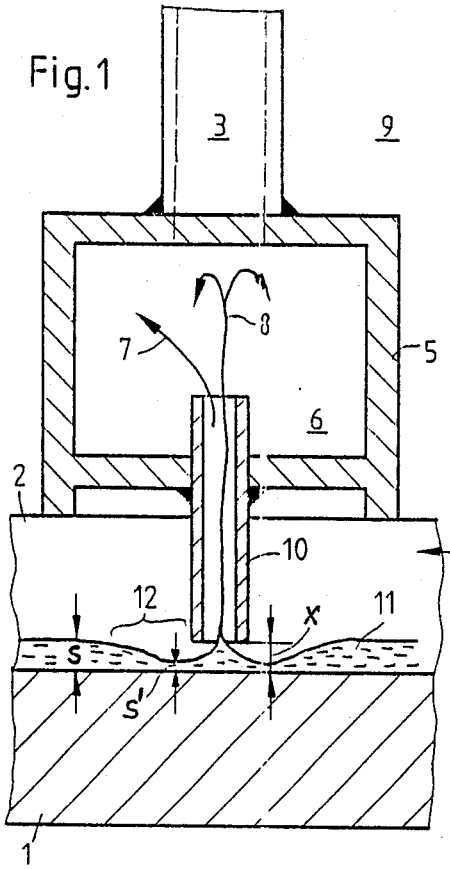
FIG. 1 is a cross-sectional view of a fragmentary portion of a drying cylinder according to the prior art with such cross-sectional view being taken on a plane generally perpendicular to the axis of rotation of the drying cylinder.

The fragmentary cross-sections shown in FIGS. 1 to 4, 7 and 8 are views obtained by a sectional plane passing through the drying cylinder perpendicular to the axis of rotation of such cylinder and perpendicular to the coincident axis of revolution of the cylinder shell (generally according to FIG. 1 of said Patent Specification No. 23-38-922). For ease of illustration, the outer and inner surfaces of the cylinder wall or shell have been shown as straight lines; however, in reality, such are cylindrically curved in the usual way.

In FIGS. 1 through 9, the same or similar elements are identified with the same reference numbers or letters.

Figure 5:
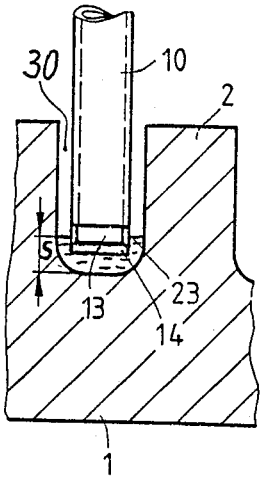
FIG. 5 is a cross-sectional view taken generally on the plane of line V of FIG. 3 and looking in the direction of the arrow.
Figure 6:
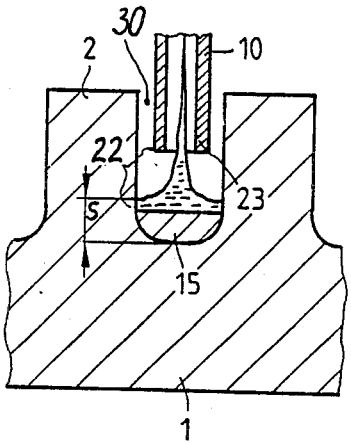
FIG. 6 is a cross-sectional view taken generally on the plane of line VI of FIG. 4 and looking in the direction of the arrow.
Figure 9:
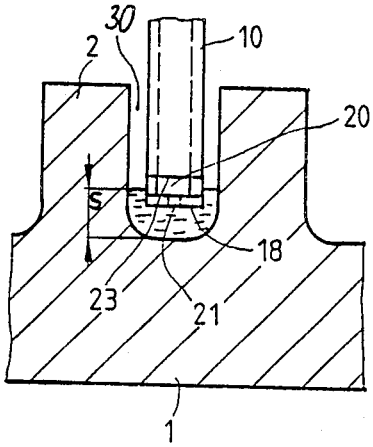
FIG. 9 is a cross-sectional view taken generally on the plane of line IX of FIG. 8 and looking in the direction of the arrow.

The prior art structure of FIG. 1 is depicted as comprising a cylindrical wall or shell 1 of a drying cylinder provided on the interior thereof with a plurality of circumferential ribs one of which is shown at 2. The cross-sectional view of FIG. 1 is taken in the region of one of the plurality of circumferential grooves respectively situated as between two adjoining but axially spaced circumferential ribs 2. In FIGS. 5, 6 and 9, functionally equivalent grooves are depicted at 30. In FIG. 1 the circumferential rib 2, beyond the plane of the cross-section, is shown in elevation.

Still with reference to FIG. 1, a condensate collection pipe or manifold 5 is shown as being situated at right angles to the circumferential direction 4 as to be generally parallel to the axis of rotation of the drying cylinder. The interior 6 of pipe or manifold 5 is in communication with a plurality of suction pipes one of which is shown at 10. Such plurality of suction pipes respectively extend into and communicate with respective ones of the plurality of circumferential grooves (as typically illustrated at 30). The distance between the bottom of the circumferential groove and the inlet aperture of the suction pipe 10, referred to as "siphon distance" for short, is designated by x. In FIG. 1, this siphon distance is relatively small as is known in the art. The condensate collection pipe or manifold 5 rests or is supported on the circumferential ribs 2 of the cylinder wall 1. Consequently, when the drying cylinder is in operation, rotating, the collection pipe or manifold rotates in unison with the cylinder.

As a result of a pressure differential between the interior 9 of the drying cylinder and the interior 6 of the condensate collection pipe or manifold 5, a part of the steam, a so-called "slip steam" designated as at 7, and condensate 8 flows through each of the siphon pipes 10 into the interior 6 of the condensate collection pipe or manifold 5. The slip steam and condensate, in turn, leave the interior 6 through a conduit 13 which is connected to associated discharge channel means (not shown but well known in the art) disposed coaxially to the drying cylinder. Such discharge channel means serves to convey the condensate, in the known way, to the outside of the drying cylinder through one of the journal bearings of the drying cylinder.

A ring 11 of condensate is formed in each circumferential groove (such groove being typified as at 30 of FIG. 5) as a result of centrifugal force acting on it during rotation of the drying cylinder. The condensate ring 11 is of a thickness or depth, s, in the radial direction with such thickness, s, being roughly equal to the siphon distance, x. During removal of the condensate, the condensate within the circumferential grooves flows along the bottom of the circumferential groove from both sides in the direction towards the siphon pipe 10. Shortly before the condensate reaches the siphon pipe 10, as depicted by and in a region 12, a considerable reduction in the thickness, s, of the ring 11 of condensate results from an increase in the flow velocity of the condensate. As a consequence, in the vicinity of the siphon pipe 10, where the condensate height or thickness, s', is less than in the areas farther away from the siphon pipe 10, there is greater heat transmission through the cylinder wall 1 with such, of course, being undesirable. As should be apparent, the greater heat transmission occurs because in such area or region of reduced thickness, s', the heat-insulating effect of the condensate is reduced. Even though the prior art structure of FIG. 1 exhibits such a disadvantage it nevertheless does function to accommodate for variations in the quantity of condensate. That is, it is known that the amount of condensate within a circumferential groove may periodically vary and that, in comparison, the amount of condensate in some circumferential grooves may periodically be greater than the amounts in the remaining circumferential grooves of the drying cylinder. In the prior art structure of FIG. 1, with the small siphon distance, x, the conveying of such varying amounts of condensate does not give rise to any notable difficulties and, in the main, the thickness, s, of the ring 11 of condensate remains largely the same in all circumferential grooves.

Figure 2:
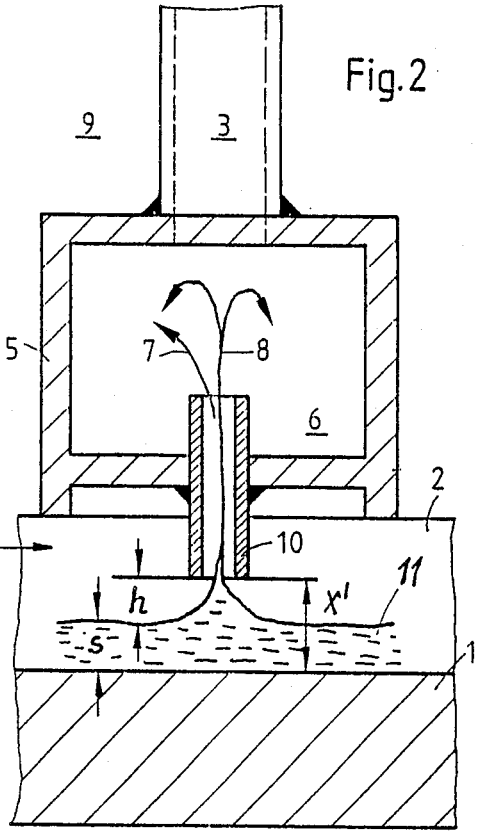
FIG. 2 is a cross-sectional view of a fragmentary portion of a drying cylinder according to the prior art, with such cross-sectional view being taken on a plane generally perpendicular to the axis of rotation of the drying cylinder, and showing a siphon pipe having a siphon distance substantially greater than the siphon distance depicted in FIG. 1.

The prior art structure of FIG. 2 differs from the structure of FIG. 1 primarily in that the siphon pipe 10 of FIG. 2 extends less far into the circumferential groove.

In the FIG. 2 embodiment, the relatively large siphon distance, x', is greater than the thickness, s, of the ring 11 of condensate by an amount equal to the so-called suction head, h. With this arrangement obviously no notable increase in the flow velocity in the condensate occurs in the vicinity of the siphon pipe 10, no doubt because the accelerating effect of the slip steam 7 on the condensate is less. Consequently, in contrast to FIG. 1, the thickness, s, of the film of condensate in the region of the siphon pipe 10 is not notably smaller than in regions away from the siphon. The heat-insulating effect of the condensate is therefore more uniform along the circumference of the drying cylinder than with the arrangement according to FIG. 1. However another disadvantage now arises; that is, if for any reason the amount of resulting condensate increases and if consequently the thickness, s, of the film of condensate 11 increases over the entire circumference of the cylinder, then it would be necessary that more condensate 8 be removed through suction pipe 10 than before. Unfortunately this is not the case with the prior art structure of FIG. 2. Apparently, in the FIG. 2 embodiment, the slip steam 7 loses speed as the quantity of condensate becomes larger by momentum exchange with the result that the accelerating effect of the slip steam on the condensate becomes even less than before.

If, for example, there is more water to evaporate in one particular circular zone of the drying cylinder than in the remaining zones of the cylinder because the approaching paper web to be dried is wetter, then a greater amount of condensate is produced in this circular zone. However, since in the FIG. 2 structure no corresponding increase in the removal of condensate from this circular zone can occur, there the thickness, s, of the condensate film 11 increases, so that resistance to heat transmission through the cylinder wall 1 increases in this region. The result of this is that the error in the moisture cross direction profile of the paper web is increased even more.

Figure 3:
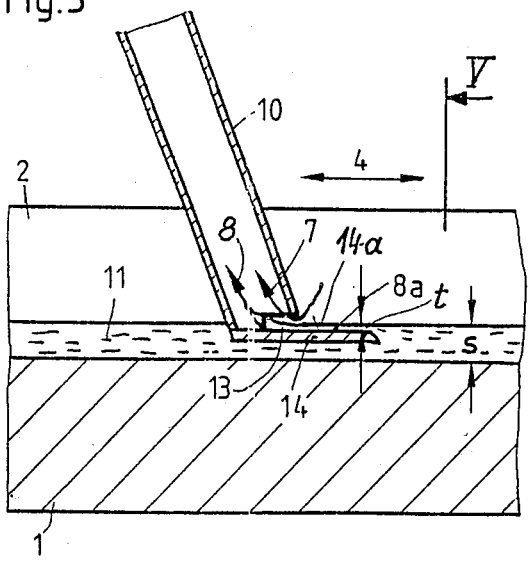
FIG. 3 is a cross-sectional view of a fragmentary portion of a drying cylinder assembly employing teachings of the invention with such cross-sectional view being taken on a plane generally perpendicular to the axis of rotation of the drying cylinder.

In FIGS. 3 to 6 and 9 the condensate collection pipe 5 or manifold is not shown, but only the lower end of one of the plurality of suction pipes 10, which, in FIG. 3, is inclined relative to the radial direction and extends between two circumferential ribs 2 into the condensate 11 and leads to collection pipe 5. In FIG. 3 the suction pipe 10 has at its external end a small plate 14 extending in the circumferential direction 4 of the cylinder, and limiting or defining, at suction pipe 10, an inlet slit 13. The thickness of the small plate 14 is only a fraction of the thickness, s, of the condensate film 11. The small plate 14 is completely submerged in the thickness, s, of condensate film 11, so that on the surface of small plate 14 turned towards the axis of the cylinder, on the so-called guide surface 14*a*, a thin film of condensate 8*a*, for example, with a thickness, t, of 1.0 mm., flows in through the slit 13 into the suction pipe. In other words, the condensate 11 flows directly infront of the entrance to suction pipe 10, similarly as in FIG. 1, but in the form of a very thin film 8*a*. However, in contrast to FIG. 1 this thin film 8*a* is essentially at the same height as the upper surface of the condensate in the remaining region of the circumference of the cylinder. Consequently, the thickness, s, of the entire condensate film in the direct vicinity of suction pipe 10 is essentially the same as in the remaining part of the circumference of the cylinder and high heat transmission in the region of suction pipe 10 is avoided. At the same time the following is achieved: If the resultant amount of condensate changes, the thickness, s, of condensate film 11, in contrast to FIG. 2, varies only by very small amounts. Only thickness, t, of the thin condensate film 8*a* flowing over small plate 14 alters with the amount of condensate. For example, if there is an increase in thickness, t, then the transport effect of the slip steam 7 is maintained; however, at the same time the cross section of condensate 8*a* flowing over small plate 14 increases and consequently so does the amount of condensate removed. Consequently a notable increase in thickness, s, of condensate film 11 is avoided in the area away from the siphon. As an example: If thickness, t, is approximately 1.0 mm., then an increase of 10.0% in the amount of condensate removed brings about a rise in thickness, s, of only 0.1 mm. Therefore the guide surface 14*a* of condensate conveying element 14 is always disposed a small distance, as in the order of magnitude of 1.0 mm., below the desired condensate level.

Figure 4:
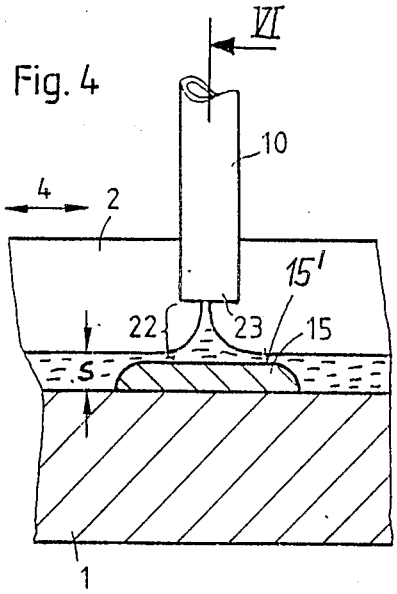
FIG. 4 is a cross-sectional view of a fragmentary portion of a drying cylinder assembly comprising another embodiment of the invention.

FIGS. 4 and 6 show a design which in principle has the same mode of operation as that of FIGS. 3 and 5, but using a radial siphon pipe 10 as shown in FIG. 2. In this construction a small plate 15, which has a guide surface 15', is mounted on the cylinder wall 1 between ribs 2. In this case there is a somewhat greater distance 22 between guide surface 15' and the inlet end 23 of suction pipe 10. However, even here the flow of condensate to siphon pipe 10 occurs in the form of just a thin film which is on the same level as the level of condensate in the region away from the siphon. Only if the amount of slip steam falls below a certain minimum (as a result of an impermissible reduction in the pressure difference between cylinder interior 9 and the interior 6 of condensate collection pipe 5), does condensate depth, s, increase by notable amounts.

Figure 7:
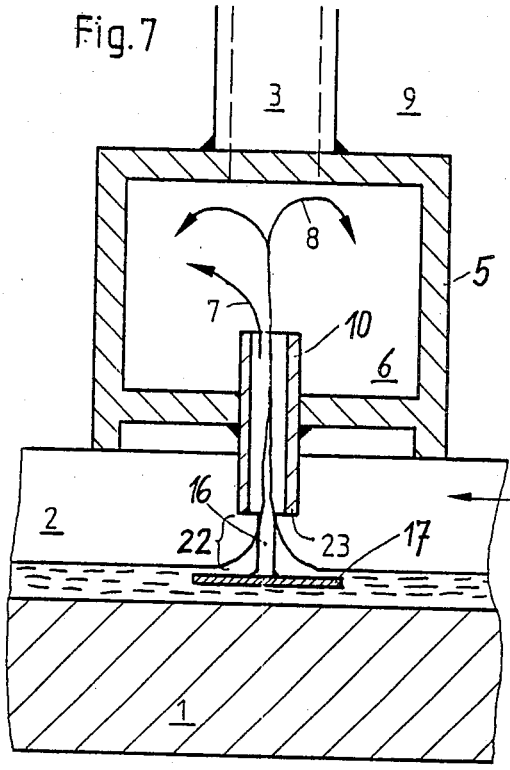
FIG. 7 is a view similar to any of FIGS. 1–4 but illustrating yet another embodiment of the invention.

FIG. 7, illustrating another embodiment of the invention, discloses the lower end of suction pipe 10 being provided with a base plate 17 which is held by means of bars 16 at a relatively great distance 22 from the inlet end 23. This base plate 17 works in the same way as the condensate conveying elements 14 and 15 shown in FIGS. 3 to 6.

Figure 8:
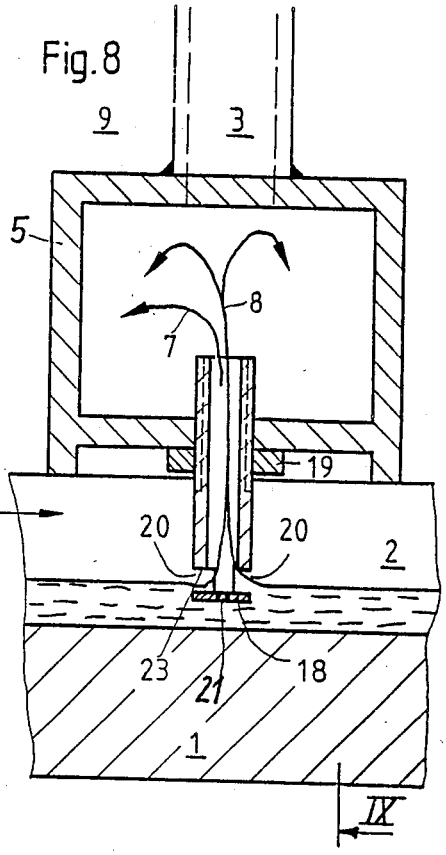
FIG. 8 is a view similar to any of FIG. 1–4 and 7 but illustrating a further embodiment of the invention.

In FIG. 8 a siphon pipe 10 having a small base plate 18 is screwed into a female screw thread of condensate collection pipe 5. Pipe 10 is secured against rotation by lock nut 19. If the small base plate 18 is circular, pipe 10 having small base plate 18 and slits 20 for drawing in condensate 11 can be very easily produced in one piece by mechanically working a round bar. FIG. 9 shows a view of siphon pipe 10 of FIG. 8; slit 20 and small base plate 18 are easily recognizable. Small base plate 18 may also be equipped with an additional hole 21 for condensate removal. However this hole has to be small enough so that under normal operating conditions it can only admit a small part of the amount of condensate so that the height, s, of condensate in the groove is always determined by the upper surface of small plate 18, such upper surface being the guide surface means of plate 18.

Although only four embodiments of the invention have been disclosed and described, it is apparent that other embodiments and modifications of the invention are possible within the scope of the appended claims.

What is claimed is:

1. In a drying cylinder of the type heated by steam and comprising circumferential grooves on the internal surface of the cylinder shell for collecting condensate resulting from the steam, at least one condensate collection pipe for removing condensate from the drying cylinder, said collection pipe extending transversely across the circumferential grooves, and a plurality of suction pipes operatively connected to said collection pipe and having respective inlet ends extending into said circumferential grooves, the improvement comprising:

(a) a condensate conveying element situated in the region of the inlet of each suction pipe;

(b) each condensate conveying element comprising condensate guide surface means extending substantially parallel to the bottom of a circumferential groove; and (c) said condensated guide surface means being positioned between said bottom of said circumferential groove and said inlet end of said suction pipe.

2. The improvement according to claim 1 and further comprising the placement of said suction pipes as to have the major flow axes thereof skew to the radius of the drying cylinder.

3. A drying cylinder according to claim 1 wherein said condensate conveying element comprises a plate, and wherein said plate is fixed to said inlet end of said suction pipe as to have said condensate guide surface means of said plate directed generally toward said inlet end of said suction pipe.

4. The improvement according to claim 1 and further comprising adjustment means for selectively adjusting the length to which a suction pipe extends into a said circumferential groove.

5. The improvement according to claim 4 wherein said adjustment means comprises a threadable connection operatively interconnecting said suction pipe with said collection pipe.

6. The improvement according to claim 4 wherein said condensate element comprises a plate having said condensate guide surface means carried thereby, and wherein said plate is fixed to said inlet end of said suction pipe as to along with said condensate guide surface means undergo movement in unison with said suction pipe when said suction pipe is being selectively adjusted.

7. In a drying cylinder of the type heated by steam and comprising circumferential grooves on the internal surface of the cylinder shell for collecting oondensate resulting from the steam, at least one condensate collection pipe for removing condensate from the drying cylinder, said collection pipe extending transversely across the circumferential grooves, and a plurality of suction pipes operatively connected to said collection pipe and having respective inlet ends extending into said circumferential grooves, the improvement comprising a condensate conveying element situated in the region of the inlet of each suction pipe, each condensate conveying element comprising guide surface means extending substantially parallel to the bottom of a circumferential groove, and said guide surface means being positioned between said bottom of said circumferential groove and said inlet end of said suction pipe, wherein said condensate conveying element comprises a plate, wherein said plate is fixed to said inlet end of said suction pipe, and wherein said plate is of a disk-like configuration.

8. In a drying cylinder of the type heated by steam and comprising circumferential grooves on the internal surface of the cylinder shell for collecting condensate resulting from the steam, at least one condensate collection pipe for removing condensate from the drying cylinder, said collection pipe extending transversely across the circumferential grooves, and a plurality of suction pipes operatively connected to said collection pipe and having respective inlet ends extending into said circumferential grooves, the improvement comprising a condensate conveying element situated in the region of the inlet of each suction pipe, each condensate conveying element comprising guide surface means extending substantially parallel to the bottom of a circumferential groove, and said guide surface means being positioned between said bottom of said circumferential groove and said inlet end of said suction pipe, wherein said condensate conveying element comprises a plate fixed in said circumferential groove.

9. A drying cylinder according to claim 8 wherein said plate substantially fills the bottom of said circumferential groove as to thereby require substantially all flow of said condensate as occurs relative to said plate to occur along and with respect to said guide surface means.

10. In a drying cylinder of the type heated by steam and comprising circumferential grooves on the internal surface of the cylinder shell for collecting condensate resulting from the steam, at least one condensate collection pipe for removing condensate from the drying cylinder, said collection pipe extending transversely across the circumferential grooves, and a plurality of suction pipes operatively connected to said collection pipe and having respective inlet ends extending into said circumferential grooves, the improvement comprising a condensate conveying element situated in the region of the inlet of each suction pipe, each condensate conveying element comprising guide surface means extending substantially parallel to the bottom of a circumferential groove, said guide surface means being positioned between said bottom of said circumferential groove and said inlet end of said suction pipe, adjustment means for selectively adjusting the length to which a suction pipe extends into a said circumferential groove, wherein said condensate element comprises a plate, wherein said plate is fixed to said inlet end of said suction pipe as to undergo movement in unison with said suction pipe when said suction pipe is being selectively adjusted, and wherein said plate is of a a disk-like configuration.

* * * * *